United States Patent [19]

Ehler

[11] Patent Number: 4,940,231

[45] Date of Patent: Jul. 10, 1990

[54] BALL RECEPTOR FOR BASKETBALL RETURN MACHINES AND THE LIKE

[76] Inventor: David G. Ehler, 560 S. Coors Ct., Lakewood, Colo. 80228

[21] Appl. No.: 255,059

[22] Filed: Oct. 7, 1988

[51] Int. Cl.[5] ..... A63B 63/08

[52] U.S. Cl. ..... 273/1.5 A

[58] Field of Search ..... 273/1.5 A, 395–397, 273/400; 56/329

[56] References Cited

U.S. PATENT DOCUMENTS

| | | | |
|---|---|---|---|
| 66,807 | 7/1867 | Darling | 56/329 |
| 210,168 | 11/1878 | Titus | 56/329 |
| 1,208,235 | 12/1916 | Thayer | 273/400 |
| 2,509,569 | 5/1950 | Langford | 56/329 |
| 2,649,680 | 8/1953 | Brown | 56/329 |
| 3,776,550 | 12/1973 | McNabb | 273/1.5 A |

FOREIGN PATENT DOCUMENTS 3709945 10/1988 Fed. Rep. of Germany ... 273/1.5 A

*Primary Examiner*—Paul E. Shapiro
*Attorney, Agent, or Firm*—Kyle W. Rost

[57] ABSTRACT

A broad faced, low angle, funnel shaped net leads to a flexible discharge tube of approximately one-quarter larger diameter than the balls play. An upper perimetric frame holds open the net while a base frame is joined to the outlet end of the discharge tube to tension the net and the discharge tube. Connecting arms establish a predetermined spacing between the upper and base frames and support the upper frame in its open position. Hinged portions of the upper frame allow it to be folded into a compact, "X" shaped storage configuration.

19 Claims, 2 Drawing Sheets

BALL RECEPTOR FOR BASKETBALL RETURN MACHINES AND THE LIKE

BACKGROUND OF THE INVENTION

1. Field of the Invention

The invention generally relates to amusement devices and games, and more specifically relates to basketball and basketball training devices. A receptor having a net, net frame, and stand therefor are disclosed, which are especially suited for use with basketball return machines.

2. Description of the Prior Art

In many sports that employ balls, such as basketball, baseball, and tennis, it is useful to have a machine that is able to project balls toward a player for practice purposes. Thus, appropriate machines have been developed to aid practice in these and other sports by throwing the ball to a player. However, basketball is unique from the other mentioned sports for several reasons. One is that the balls are larger and more expensive than baseballs or tennis balls. As a result, it would be expected that there will be comparitively fewer basketballs in use during a practice session. Correspondingly, the machine will have a reservoir holding a relatively smaller number of basketballs. For this reason, basketballs tend to be recycled through the throwing machine with greater frequency.

By further comparison to tennis and baseball, another uniqueness is that the basketball player is not as interested in practicing receiving the returned ball as he is in shooting the ball at the goal. Thus, the basketball return machine is able to take advantage of the goal-shooting nature of basketball practice by recovering balls from the goal and in this way compensating for the typically smaller number of balls in play.

One of the primary and unique problems faced by a basketball return machine is to have an adequate means for gathering the limited supply of balls from the goal and feeding the balls into the return mechanism. From the standpoint of gathering the largest number of basketballs that are shot at the goal, it would be desirable to employ a hopper located below the basketball goal. Since some shots miss the goal, this hopper is desired to be of large diameter so that it will catch many of the missed shots. However, a countervailing consideration is that the hopper and its associated return machine must be removed and stored when practice is over. Thus, the hopper should be manageable for removal and storage.

A further requirement of a hopper for basketballs is that the balls generally must be fed single file into the return machine. Basketballs in a hopper may log-jam before the single-file feed point. It would be desirable to have a hopper that is capable of feeding the gathered balls in single file with consistency. Of course, there are known mechanical movements that can feed a single sphere from a hopper, but if such a movement is sized to handle basketballs, it may be costly, bulky in size, mechanically complex, and difficult to handle for storage. In view of the need to move and store the basketball return machine, it would be desirable to achieve a consistent single file feed via a passive mechanism.

The following United States Patents disclose ball return machines and demonstrate the state of the art. U.S. Pat. No. 3,776,550 to McNabb discloses a large collecting basket framework located below the hoop. A chute leads from the framework to a return mechanism, which employs a projecting arm to return the ball to the shooter. U.S. Pat. No. 4,362,348 to Griffith discloses a machine for returning soccer balls. A large hopper holds the store of balls, and a mechanical auger feeds the balls into a feed chute within the return machine. There, a pair of rotating wheels expel the ball toward the player. U.S. Pat. No. 4,193,591 to Paulson discloses another ball return device that employs a feed chute leading to counter-rotating ball projecting rollers, all of variable spacing. U.S. Pat. No. 4,579,340 to Jenkins et al. discloses a feed chute that receives basketballs shot through the hoop and feeds them to a horizontally rotatable ball return mechanism. U.S. Pat. No. 4,678,189to Koss discloses a height adjustable, frame-like collection basket that catches basketballs and funnels them to a feed chute where, again, twin rollers expel the ball.

Another type of ball return device passively redirects basketballs back toward players in front of the basket. U.S. Pat. No. 3,901,506 to Caveney and U.S. Pat. No. 1,765,269 to Hatley disclose devices of this type, wherein ball-retrieving chutes or slides attach to the backboard and guide the ball back to the basketball court.

A further type of device is suspended from the hoop and kicks back any balls that pass through the hoop. U.S. Pat. No. 2,808,264 to Scalf discloses a ball ejecting machine that hangs from the hoop and returns each individual basketball that is shot through the hoop. U.S. Pat. Nos. 3,471,150 to Kaerwer and 3,105,683 to Kimbrell disclose other rebounding devices that eject each individual ball that passes the hoop. Since each ball is ejected individually, immediately, there is no hopper or single-file feed mechanism. U.S. Pat. No. 3,446,504 to Pascucci teaches still another ball ejector device that attaches to the hoop. The main function of these devices appears to be development of rebounding skills.

As can be understood from this described state of the art, there are three general types of devices in the prior art: return ball projectors, backboard mounted return guides, and hoop mounted ejectors. Of these, the first has superior utility and versitility in promoting goal shooting skills. The present invention primarily is intended for use with ball projecting machines and remedies the problems as noted.

To achieve the foregoing and other objects and in accordance with the purpose of the present invention, as embodied and broadly described herein, the net, frame and stand of this invention may comprise the following.

SUMMARY OF THE INVENTION

Against the described background, it is therefore a general object of the invention to provide an improved recovery receptor for basketballs that are shot through or near the hoop.

Another object is to provide a ball gathering receptor that is capable of directing the balls in single file out of the receptor, such as into an associated return machine.

Still another object is to provide a wide diameter receptor that can be collapsed into a compact package, such as for storage.

A further object is to provide a support structure for a net, wherein the support structure is easily folded or erected.

An additional object is to provide a receptor having a passively operating feeding system for directing balls in single file out of the receptor.

Still a further object is to provide a support structure that aids in collapsing or assembling the net and net frame.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a ball receptor provides a flexible net body of generally conical shape having a depending flexible ball discharge tube. A perimetric net frame carries the net body and has a plurality of foldable hinges at spaced intervals about the net frame. The hinges are oriented to permit folding the net frame in more than one plane. A plurality of support arms carry the net frame.

According to another aspect of the invention, a ball receptor for receiving balls of approximately known similar diameters and discharging the balls in single file provides a generally funnel shaped body of flexible material, having an upper, relatively broader inlet end and a lower, relatively narrower discharge end. A supporting means is joined to the body for maintaining the inlet end in open condition and applying vertical tensioning substantially between the inlet and discharge ends.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENT

Figure 1:
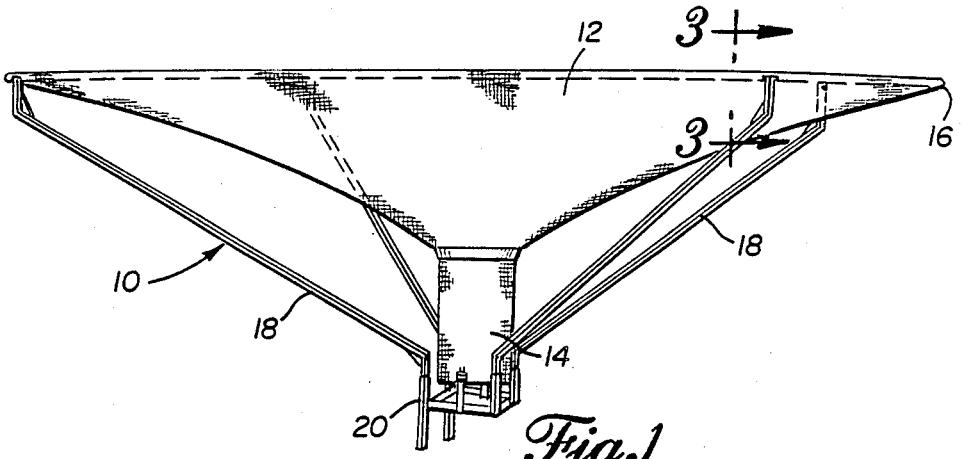
FIG. 1 is a side elevational view of the receptor.
Figure 2:
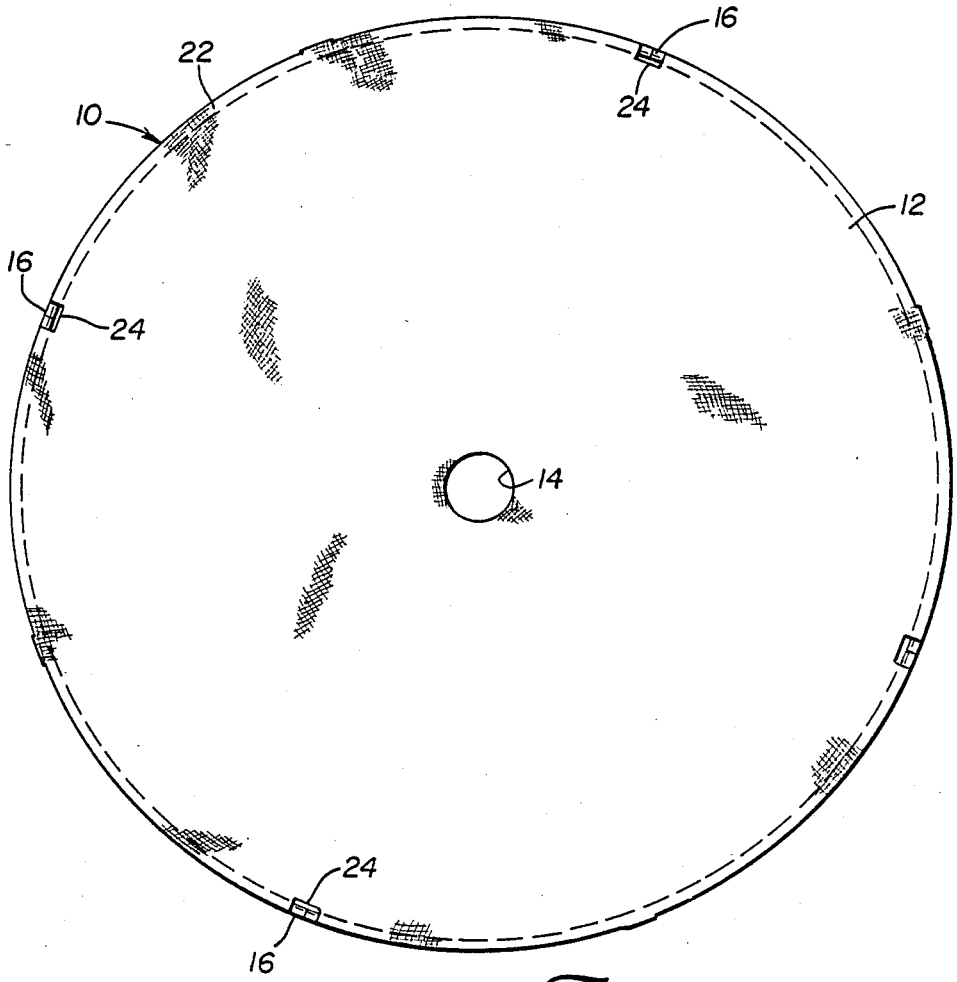
FIG. 2 is a top plan view of the receptor.

As best shown in FIGS. 1 and 2, the invention is a ball receptor 10 that includes a flexible, resilient ball collecting body 12 having a flexible ball discharge tube 14. The collecting body is formed from fabric or similar sheet material. A support means of more rigid material maintains the collecting body in its desired shape. This support means may include a frame 16 that carries the body 12 and, in turn, is carried by support arms 18. The support arms may be joined to a frame base 20 that is adapted to be mounted on a ball return machine. The receptor provides a broad gathering surface in collecting body 12 that may be located under a basketball hoop for recovering any balls shot in the area near the hoop. The collecting body 12 guides the balls toward the flexible ball discharge tube 14, where the flexible nature and preselected diameter of the tube permits the balls to drop through substantially in single file, without jamming. Thus, the ball receptor 10 is suited for use with substantially any ball return machine that can receive and handle balls presented in single file.

Figure 3:
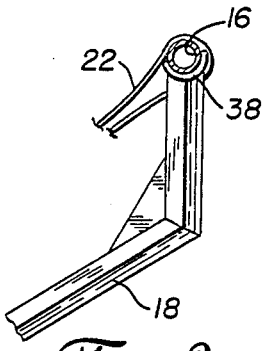
FIG. 3 is an enlarged fragmentary cross-sectional view taken across the plane of line 3—3 in FIG. 1, showing the junction of a frame support arm and the net frame.

The ball collecting body 12 is preferred to be formed of a flexible fabric such as netting. For this reason, the body 12 may be referred to as the net. A circular, large diameter net is preferred, such as an eleven to twelve foot diameter. At its circumference the round disk of net material is attached to a more tightly woven, stronger fabric ring or perimetric sleeve 22, which may the formed of canvas or nylon. As shown in FIG. 3, this fabric ring may be formed into a circular tube or sleeve at the perimeter of the net, and the tube may receive the metal frame 16. Both edges of the fabric ring 22 may be sewn to the net in order to close the tube, or the ring may be closed by snaps, laces, Velcro, or other types of fabric fastening means. The tube forms one or more notches 24 in its outer edge, which provide a passage for insertion or removal of the net frame 16. The number and location of the notches 24 are desired to correspond to the number and location of hinges 26 in the frame 16, as will be more fully described below. Generally, the notches will be even in number, preferrably four, and equally spaced about the perimeter of the net.

The ball discharge tube 14 is preferred to be attached to the net near its center and to be of substantially uniform diameter throughout its length. This tube may be formed of a flexible material such as strong textile fabric, for example canvas. From its central location, the tube 14 depends from and tensions the center of the net and causes the net to assume a conical or funnel-like shape, leading into the tube. The face of the net itself is relatively flat or at an acute angle to the ground, with thirty degrees being a typical approximate angle of inclination. Basketballs striking the net face are captured by the yielding flexibility of the net and then are guided toward the discharge tube inlet. It is desirable for the net to be under sufficient tension that it has some resilience or "life," so that the balls are kept rolling toward the bottom of the funnel shape.

The diameter of the tube is slightly larger than the diameter of a basketball or whatever other ball is to be used with the receptor. However, this tube diameter should be less than one and one-half times the diameter of the ball, with the preferred diameter range being from one and one-third to one and one-quarter times the ball diameter. The single preferred diameter of the tube is approximately one-quarter larger than the diameter of the ball, with the result that two balls cannot both have their centers of gravity over the inlet of the tube. For example, it has been found that in the single preferred embodiment that returns basketballs, which are about ten and one-half inches in diameter, the diameter of the tube should be approximately thirteen inches, plus or minus one-quarter inch. It is believed that a similar ratio between ball diameter and discharge tube diameter will result in the reliable, single file feeding of other types and sizes of balls. Thus, the balls received in the net are drawn by gravity to the discharge tube, where the balls pass freely down the tube. The flexibility and tension of the net and the tube discourage the balls from jamming or wedging at the inlet of the discharge tube, with the result that the discharge tube reliably feeds the balls in single file.

Figure 8:
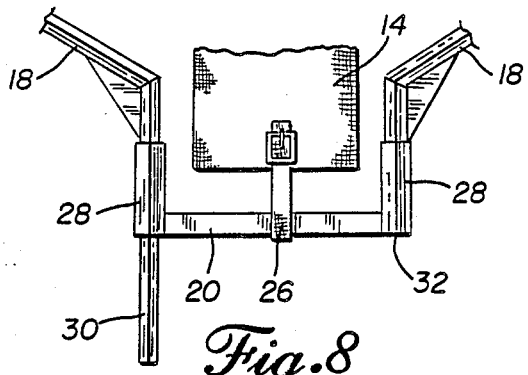
FIG. 8 is a detail side elevational view of the ball discharge tube and its connection to the net frame.

As shown in FIG. 8, the lower end of the discharge tube may include a means for fastening the tube to the frame base 20, for example by one or more straps 26 or like fastening means. The straps 26 may be buckled to the desired degree of tightness, which also establishes the slope of the net and places the net and discharge tube under tension. Four straps 26 are preferred, equally spaced about the circumference of the outlet. The straps maintain the net in a lively condition so that balls feed rapidly to the discharge tube and do not nest on the net.

The frame base 20 provides an anchor point for the straps 26 and defines a central ball passageway that is generally aligned with the ball discharge tube. The straps 26 maintain the outlet of the discharge tube in the desired alignment with the passageway. The frame base 20 may be square and may be joined to the lower end of the support arms 18, one at each corner of the square frame. The arms 18 also establish a fixed separation between the base frame and the net frame. The discharge tube is preferred to have its outlet above the base frame, so that the lower edge of the outlet may be held in tension from the frame 20 by the straps 26. For use with basketballs, the lower edge of the discharge tube is preferred to be about three inches above the frame 20. In addition, as balls fall through the discharge tube, the sides of the tube have no rigid objects nearby to interfere with or jam the balls within the tube. Only after the balls fall free of the tube in single file do they pass through the passageway of the frame, where jamming is no longer a problem.

With further reference to FIG. 8, it is shown that the frame 20 may have associated vertical corner tubes 28 that receive the lower ends of the support arms in telescopic engagement. Some or all of the corner tubes also may include depending pins 30 that can be used to align the frame base on an associated ball return machine of any suitable type, not shown. The alignment pins 30 may mate with suitable holes at the sides of the ball inlet of the return machine, thus placing the receptor in the desired position to feed balls into the machine. Two such alignment pins are adequate to establish the location of the frame base on the ball return machine. The remaining two corner tubes 28 may terminate at their lower ends 32 flush with the frame 20 and may rest passively on the ball return machine. The alignment pins 30 also may be used to trigger a micro-switch on the ball return machine, so that the machine is protected from operation without having a net in place.

Net frame 16 is formed of tubular sections 34 joined together by hinges 36 to define a ring or other desired shape, corresponding to the perimeter of the net 12. When the frame 16 is inserted in the net sleeve 22, the hinges 36 line up with the notches 24 and are exposed. In this exposed position, the hinges may be folded without removing the frame 16 from the sleeve, which simplifies storing the net and frame. FIG. 3 shows that the support arms 18 carry a channel shaped cup 38 at their upper ends, which cup 38 fits partially around a hinge 36 to support the hinge and net frame in open position. Thus, the entire net and net frame are mounted on the support arms merely by resting under gravity in cups 38. In addition, the straps 26 secure the net frame in this position by providing a tensioning force.

Figure 4:
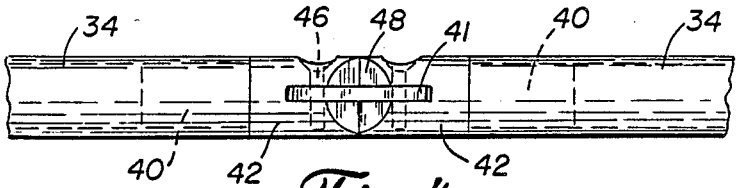
FIG. 4 is a detail top plan view of a net frame hinge point, showing internal structure in broken lines.
Figure 5:
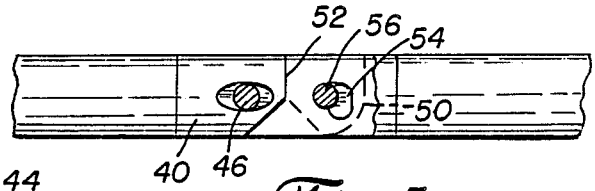
FIG. 5 is a detail side view of a net frame hinge point similar to FIG. 4, with the side wall of the net frame broken away to show details of the hinge plate.
Figure 6:
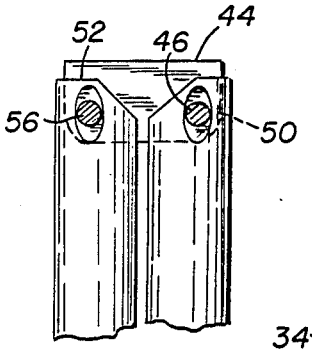
FIG. 6 is a detail view similar to FIG. 5, showing the hinge in folded position.

FIG. 4 shows details of the hinges 36 that join the tubular sections 34. Each hinge includes a shank portion 40 that fits telescopically within an end of the open core of a tubular section 34. At the outer end of the shank is a hinge head 42 of larger diameter than the open core, limiting the distance to which the shank can be received within the core. Each head 42 is slotted to receive one-half of a hinge plate 44, each hinge plate being shared between two heads of the same hinge. A pivot pin 46 extends through each head and the contained portion of the plate, locking the plate and two heads together. Thus, the hinges are double pivoted by having two pivot pins in each head. The hinge heads 42 are beveled at facing edges 48 in the direction of folding. Further, as shown in FIG. 5 and 6, the hinge plate has curved corners 50 at the inside edge of the plate facing the direction of fold. Thus, the hinges 36 permit the net frame sections 34 to move between unfolded positions as shown in FIGS. 4 and 5, wherein the sections are substantially aligned end-to-end, such as in a circle, and folded positions as shown in figure 6, wherein the sections are folded parallel to each other. The hinges will not fold in reverse direction from unfolded position. When in unfolded position, the net frame is held against reverse folding by face-to-face contact between non-beveled facing edge portions 52, as shown in FIG. 5.

The hinges are able to permit the frame sections to fold into substantially parallel positions. In FIGS. 5 and 6, the aperture 54 in the hinge plate is shown to be L-shaped with two perpendicularly extending lobes 56 and 58, which permit the hinge to accommodate parallel positions of the frame sections by sliding the pin 46 into the appropriate lobe of the aperture. Lobes 56 extend longitudinally of the hinge plate and receive the hinge pins when the net frame is in unfolded position as shown in FIG. 5. Lobes 58 extend laterally of the hinge plate and receive the hinge pins when the net frame is in folded position as shown in FIG. 6.

When the net frame has four hinges as shown in FIGS. 1 and 2, the hinges are arranged in first and second pairs. Each pair is divided on substantially opposite edges of the net frame, for example by being diametrically on opposite sides of the ring. The first hinge pair is oriented to pivot in substantially the same direction, for example to enable the net frame to be folded from a full circle into a half circle. Thus, the pivot axes of the first pair would lie substantially in the plane of the net frame when the frame is in unfolded position. The first pair of hinges are further oriented to allow the half circles of the net frame to fold in an upward direction from the hinges. Thus, when the net frame is in unfolded position, the first pair of hinges is locked against allowing the net frame to collapse downwardly from the hinges. By supporting the net frame at the first pair of hinges, the support arms cause the net frame to remain unfolded and locked in open position at these hinges.

The second hinge pair is offset around the net frame by ninety degrees from the first pair. These second hinges have their pivot axes substantially perpendicular to the plane of the net frame when the frame is in unfolded position and, thus, are rotated ninety degrees from the pivot axes of the first pair. Thus, these hinges are inoperative when the first hinges are in unfolded position. From unfolded position, the direction of fold of both of the second hinges is toward the center of the net frame, such that these hinges are opposed to each other in direction of fold. The second hinges are further locked in unfolded position by being received in the semi-cylindrical shaped channels of the support arm cups 38.

Figure 7:
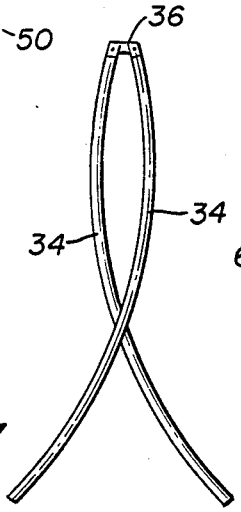
FIG. 7 is a side elevational view of the net ring in fully folded position.
Figure 9:
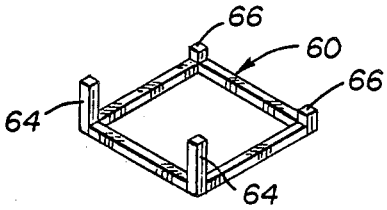
FIG. 9 is an isometric view of an assembly and disassembly stand for the receptor.

However, when the net frame is folded on the first hinges, the second hinges are moved into a position of being substantially juxtaposed and foldable in the same direction. Thus, for example, if the net frame is folded upwardly into a one-half circle, the second hinges will be located at the top of the juxtaposed semi-circles and will have substantially aligned pivot axes. The direction of fold will be downward. The semi-circle of the net frame will fold into an "X" shape as shown in FIG. 7. Thus, the large circle of the net and frame as shown in FIG. 2 can be collapsed into the extremely compact configuration of FIG. 7. Because the net and discharge tube are of flexible fabric, these elements will fold with the net frame and are compact.

As an aid to assembling or disassembling the receptor, an assembly stand 60 is provided. This stand may be used to support the frame base 20 when the base is off of the ball return machine. The stand includes its own square base 62 similar in size to base 20. A pair of upstanding supports 64 receive and support the bottom 32 of the corner tubes 28 that do not have depending pins 30. A pair of shorter supports 66 receive and support the pins 30 on the remaining two corner tubes 28.

In operation, the receptor is assembled by placing stand 60 on the floor and placing frame base 20 on the stand. Then, the support arms 18 are placed in the corner tubes in such a manner that they extend diagonally outwardly from the corners of the frame 20. The net and net frame than are unfolded into a full circle and set in the grooves of the cups 38 on the tops of the support arms. The entire receptor then can be mounted to the desired associated ball return machine and the pins 30 can be set into the associated holes in the machine. Once the receptor is in place, the straps 26 can be attached to the frame 20 and tightened to the desired degree.

The receptor is disassembled in approximately the reverse procedure. First the straps 26 are removed from the frame base 20, after which the receptor is removed from the ball return machine and placed upon the stand 60. Thereafter, the net frame is lifted off the cups of the support arms. Then the net frame is folded first into a half circle and second into an "X" shape. The support arms are lifted free of the frame base. The parts then may be stored in a realtively small area.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. A ball receptor, comprising:

a flexible net body of generally conical shape having a depending flexible ball discharge tube;

a perimetric net frame carrying said net body and having a plurality of foldable hinges at spaced intervals about the net frame, said hinges being oriented to permit folding the net frame in more than one plane; and a plurality of support arms carrying said net frame.

2. The ball receptor of claim 1, further comprising:

a frame base joined to said support arms and defining a ball passageway generally aligned with said ball discharge tube.

3. The ball receptor of claim 2, wherein said ball discharge tube terminates above said frame base and further comprises fastening means depending from the lower end of the discharge tube and attaching the discharge tube to the frame base.

4. The ball receptor of claim 3, wherein said fastening means comprises a flexible strap.

5. The ball receptor of claim 1, wherein said support arms have second ends, and said base frame carries the support arms by telescopically engaging said second ends.

6. The ball receptor of claim 1, wherein said ball discharge tube is formed of textile fabric.

7. The ball receptor of claim 1, wherein said net further comprises a perimetric sleeve and said net frame is received within the sleeve.

8. The ball receptor of claim 7 wherein said perimetric sleeve defines a plurality of openings at spaced intervals thereabout, and said hinges of the net frame are located at said openings.

9. The ball receptor of claim 8 wherein said support arms are joined to the net frame at said openings in the perimetric sleeve.

10. The ball receptor of claim 9 wherein said support arms have first ends with channel shaped cups thereon, and the support arms carry the net frame by receiving the frame hinges in the cups.

11. The ball receptor of claim 1, wherein said hinges are double pivoted and include a pivot pin hole of L-shaped contour at each pivot axis of the hinge.

12. The ball receptor of claim 1, wherein:

said net frame is moveable between an unfolded position wherein the frame lies substantially in a single plane and has frame sections aligned end-to-end, and a folded position;

said plurality of hinges comprises at least four hinges arranged in first and second pairs;

each of said pairs of hinges is divided on substantially opposite edges of the net frame;

the first hinge pair is oriented to pivot on an axis lying substantially in the plane of the net frame when the net frame is in unfolded position, such that the unfolded net frame can be folded on the axis of the first hinge pair; and the second hinge pair is rotated by approximately ninety degrees on the net frame relative to the first pair, such that when the net frame is folded at said first hinge pair, the second pair is brought into substantially juxtaposed position and is oriented to pivot on a common axis to further fold the net frame.

13. The ball receptor of claim 12, wherein said net frame is substantially a circle when in unfolded position; and the net frame is substantially in an "X"shaped configuration when in folded position.

14. The ball receptor of claim 1, further comprising:

a frame base located below said net frame and joined to said support arms; and a fastening means connecting said net body to the frame base and tensioning the net body between the frame base and net frame.

15. A ball receptor for receiving balls of approximately known similar diameters and discharging the balls in signal file, comprising:

a generally funnel shaped body of flexible material, having an upper, relatively broader inlet end and a lower, relatively narrower discharge end;

a supporting means joined to said body for maintaining the inlet end in open condition and applying vertical tensioning substantially between the inlet and discharge ends; and wherein the discharge end of said body comprises a tube of flexible material having a predetermined diameter greater than the known ball diameter and less than one and one-half diameters.

16. The ball receptor of claim 15, wherein said supporting means comprises:

an upper frame joined to said body near said inlet end;

a lower frame joined to said flexible tube;

an intermediate connecting means joining the upper and lower frames and maintaining said upper and lower frames at a predetermined distance for applying tension to the body; and an adjustable fastening means connecting said flexible tube to said lower frame for establishing a selective degree of tightness in the net.

17. The ball receptor of claim 16, wherein said adjustable fastening means comprises a plurality of the flexible tube near an outlet end thereof and joined to said lower frame.

18. The ball receptor of claim 15, wherein the discharge end of said body comprises a tube of flexible material having a predetermined diameter of between the known ball diameter and one and one-third such diameters.

19. The ball receptor of claim 15, wherein the discharge end of said body comprises a tube of flexible material having a predetermined diameter of approximately one and one-quarter times the known ball diameter.

* * * * *